US008925741B2

(12) United States Patent
Chiang et al.

(10) Patent No.: US 8,925,741 B2
(45) Date of Patent: Jan. 6, 2015

(54) SHELF FOR BOOTS STORAGE

(71) Applicants: Chun-Yi Chiang, Taichung (TW); Chun-Hsien Chiang, Taichung (TW)

(72) Inventors: Chun-Yi Chiang, Taichung (TW); Chun-Hsien Chiang, Taichung (TW)

( * ) Notice: Subject to any disclaimer, the term of this patent is extended or adjusted under 35 U.S.C. 154(b) by 22 days.

(21) Appl. No.: 13/870,568

(22) Filed: Apr. 25, 2013

(65) Prior Publication Data

US 2014/0319085 A1 Oct. 30, 2014

(51) Int. Cl.

| | |
|---|---|
| ***A47F 7/08*** | (2006.01) |
| ***A47G 25/00*** | (2006.01) |
| *A47F 5/08* | (2006.01) |
| *A47F 5/02* | (2006.01) |

(52) U.S. Cl.

CPC ..... *A47G 25/005* (2013.01)
USPC ..... 211/36; 211/118; 211/163; 211/144

(58) Field of Classification Search

USPC ..... 211/34, 36, 37, 189, 113, 118, 134, 211/186, 163, 164, 144; 108/180, 190, 186; 248/163.1, 165, 166, 172, 235, 241, 248/250

See application file for complete search history.

(56) References Cited

U.S. PATENT DOCUMENTS

| | | | | | |
|---|---|---|---|---|---|
| 446,312 | A | * | 2/1891 | Wikle | 12/123 |
| 597,862 | A | * | 1/1898 | Saunders | 211/34 |
| 658,547 | A | * | 9/1900 | Kennedy | 434/397 |
| 680,264 | A | * | 8/1901 | Mansfield | 34/104 |
| 686,314 | A | * | 11/1901 | Mansfield | 34/104 |
| 836,218 | A | * | 11/1906 | Saunders | 211/34 |
| 845,821 | A | * | 3/1907 | Rudy | 211/163 |
| 859,514 | A | * | 7/1907 | Peabody | 34/104 |
| 1,035,575 | A | * | 8/1912 | Goode | 211/204 |
| 1,058,194 | A | * | 4/1913 | O'Brien | 211/34 |
| 1,185,305 | A | * | 5/1916 | Gould | 211/37 |
| 1,198,406 | A | * | 9/1916 | Beaumont | 211/34 |
| 1,281,927 | A | * | 10/1918 | Felton | 34/104 |
| 1,450,084 | A | * | 3/1923 | Hull | 211/8 |
| 1,466,564 | A | * | 8/1923 | Samuel | 211/163 |
| 1,710,711 | A | * | 4/1929 | Patterson | 211/163 |
| 1,710,940 | A | * | 4/1929 | Murphy | 211/36 |
| 1,720,892 | A | * | 7/1929 | Hill | 211/36 |
| 1,824,230 | A | * | 9/1931 | Phelps et al. | 211/80 |
| 1,862,168 | A | * | 6/1932 | Weiskotten | 12/114.8 |
| 1,924,158 | A | * | 8/1933 | Jones | 211/34 |
| 1,961,870 | A | * | 6/1934 | Turner et al. | 211/37 |
| 2,032,933 | A | * | 3/1936 | Haumerson | 12/123 |
| 2,065,391 | A | * | 12/1936 | Nance | 312/308 |
| 2,067,095 | A | * | 1/1937 | Pease | 211/34 |
| 2,103,885 | A | * | 12/1937 | Whalen | 312/404 |
| 2,527,132 | A | * | 10/1950 | Jackson et al. | 248/131 |
| 2,703,651 | A | * | 3/1955 | Brocklehurst | 211/34 |
| 2,762,513 | A | * | 9/1956 | Zaninovich | 108/20 |

(Continued)

*Primary Examiner* — Joshua J Michener
*Assistant Examiner* — Devin Barnett
(74) *Attorney, Agent, or Firm* — Muncy, Geissler, Olds & Lowe, P.C.

(57) ABSTRACT

A shelf for boots storage includes a base, a bottom plate, at least one intermediate plate, plural connecting elements, and at least one hanging element. The bottom plate is rotatably disposed on the base. The intermediate plate is located by a side of the bottom plate opposite to the base and has a predetermined distance from the bottom plate. The connecting elements connect the intermediate plate and the bottom plate. A receiving room is defined between the connecting elements, the intermediate plate and the bottom plate. The hanging element extends from a bottom of the intermediate plate toward the receiving room, and a hanging space is defined between the hanging element and the intermediate plate.

7 Claims, 16 Drawing Sheets

(56) References Cited

U.S. PATENT DOCUMENTS

| | | | | | |
|---|---|---|---|---|---|
| 2,787,379 | A | * | 4/1957 | Fritz et al. | 211/38 |
| 2,889,936 | A | * | 6/1959 | Kassner | 211/34 |
| 3,351,403 | A | * | 11/1967 | Magnuson | 312/245 |
| 3,435,959 | A | * | 4/1969 | Levy et al. | 211/163 |
| 3,730,354 | A | * | 5/1973 | Bronstein | 211/38 |
| 3,747,774 | A | * | 7/1973 | Kulik | 211/37 |
| 3,802,572 | A | * | 4/1974 | Shackel | 211/38 |
| 4,149,290 | A | * | 4/1979 | Sansen | 12/114.8 |
| 4,236,769 | A | * | 12/1980 | Mueller | 312/135 |
| 4,534,471 | A | * | 8/1985 | Zahn et al. | 211/39 |
| 5,050,746 | A | * | 9/1991 | Frankel | 211/34 |
| 5,535,895 | A | * | 7/1996 | Valiulis | 211/59.1 |
| 5,881,653 | A | * | 3/1999 | Pfister | 108/147.13 |
| 5,964,360 | A | * | 10/1999 | Hwang | 211/186 |
| 5,984,114 | A | * | 11/1999 | Frankel | 211/34 |
| 5,984,486 | A | * | 11/1999 | Munz et al. | 362/33 |
| 6,015,053 | A | * | 1/2000 | Sheng | 211/188 |
| 6,062,150 | A | * | 5/2000 | Sikora et al. | 108/190 |
| 6,247,414 | B1 | * | 6/2001 | Sikora et al. | 108/190 |
| 6,357,610 | B1 | * | 3/2002 | Irace | 211/186 |
| 7,963,404 | B2 | * | 6/2011 | Shang | 211/36 |
| 2003/0173321 | A1 | * | 9/2003 | Craft et al. | 211/144 |
| 2005/0252869 | A1 | * | 11/2005 | Graham | 211/36 |
| 2007/0125733 | A1 | * | 6/2007 | Brandon | 211/163 |
| 2007/0221590 | A1 | * | 9/2007 | Dhaveloose | 211/34 |
| 2008/0087618 | A1 | * | 4/2008 | Laney | 211/113 |
| 2010/0066222 | A1 | * | 3/2010 | Ito | 312/326 |
| 2012/0241400 | A1 | * | 9/2012 | Hardin | 211/144 |
| 2013/0037503 | A1 | * | 2/2013 | Cimino et al. | 211/85.3 |
| 2013/0313213 | A1 | * | 11/2013 | Ellison | 211/144 |
| 2013/0334148 | A1 | * | 12/2013 | Eberle et al. | 211/1.53 |
| 2014/0097148 | A1 | * | 4/2014 | Cheng | 211/34 |

* cited by examiner

SHELF FOR BOOTS STORAGE

BACKGROUND OF THE INVENTION

1. Field of the Invention

The present invention relates to a shelf, and more particularly to a shelf for boots storage.

2. Description of the Prior Art

A conventional shelf for boots storage comprises a shelf body which has a rotatable structure. The shelf body has a plurality of positioning plates arranged therein. Under this arrangement, the boots can be placed into the shelf body from two sides of the shelf body. Therefore, it is convenient for a user to place his/her boots into the shelf body.

However, a receiving space of the shelf body is not adjustable, so that it is not fit for the boot and the boot would be deformed; the long portion of the boot would downcast and the moisture of the boot cannot exhaust from the boot; the receiving space cannot be efficiently used.

The present invention is, therefore, arisen to obviate or at least mitigate the above mentioned disadvantages.

SUMMARY OF THE INVENTION

An object of the present invention is to provide an improved shelf.

To achieve the above and other objects, a shelf for boots storage comprises a base; a bottom plate rotatably assembled on the base; at least one intermediate plate located at a side of the bottom plate opposite to the base, a predetermined distance defined between the intermediate plate and the bottom plate; a plurality of connecting elements connected between the intermediate plate and the bottom plate, a receiving room defined between the connecting elements, the intermediate plate, and the bottom plate; and at least one hanging element extended from a bottom of the intermediate plate toward the receiving room, an extended distance of the hanging element being predetermined, a hanging space defined between the hanging element and the intermediate plate. Wherein, a supporting member is extended from the bottom of the intermediate plate toward the receiving room; when one boot is hung in the hanging space, the boot is upside-down and a head portion of the boot is inserted into the hanging space; the supporting member upwardly abuts against the head portion; the hanging element has at least one pair of hanging pieces which are symmetrical with each other; a bottom end of one of the hanging pieces is bent toward another of the hanging pieces, so that each of the hanging pieces is L-shaped; an ankle portion of the boot is able to be clamped between the hanging pieces; the head portion of the boot is located at the hanging space; the hanging element further has at least one pair of further hanging pieces which are symmetrical with each other; a bottom end of one of the further hanging pieces is bent toward another of the further hanging pieces, so that each of the further hanging pieces is L-shaped; each further hanging piece is detachably assembled to a bottom end of each corresponding hanging piece; the ankle portion of the boot is able to be clasped between the further hanging pieces; the shelf for boots storage further has a top plate, a post and a top cover; the top plate is located above the intermediate plate; the top cover is located above the top plate; the top plate is connected to the intermediate plate; the top cover is rotatably connected to the top plate; one end of the post is connected to the base; another end of the post is connected to the top cover; the clasp member is extended from the bottom of the intermediate plate toward the receiving room; the clasp member has a band and a clasp portion which is assembled at a bottom end of the band; when two boots are stood in the receiving room, the clasp portion clasps two long portions of the boots together; a length of the band is adjustable; the shelf for boots storage further has a dust cover which is mounted around the shelf for boots storage; the dust cover has at least one vertical zip member which is vertically extended; the vertical zip member has two pull tabs; one pull tab can be zipped up to open the vertical zip member; another pull tab can be zipped down to open the vertical zip member; there is a plurality of said intermediate plates; a distance is defined between each two adjacent intermediate plates; each two adjacent intermediate plates are connected by the corresponding connecting elements; a further receiving room is defined between the corresponding connecting elements and each two adjacent intermediate plates; wherein, the boots are placed into the receiving room from two sides of the receiving room; the boot is selectively hung in the hanging space or stood in the receiving room; each hanging element is assembled to a bottom of the corresponding intermediate plate; each hanging element has two hanging pieces are extended from bottom of the corresponding intermediate plate toward the receiving space; two further hanging piece respectively horizontally extended form two hanging pieces; each further hanging piece of each hanging member has a supporting plane which faces the intermediate plate; each supporting plane has an inclined portion which is inclinedly extended form a bottom of the intermediate plate toward the receiving room, and a horizontal portion which is horizontally extended from a top end of the inclined portion; each horizontal portion of is parallel to the bottom of the intermediate plate; an extended portion is horizontally extended from a bottom end of the inclined portion; an extended direction of the extended portion is diametrically opposed to an extended direction of the horizontal portion; the extended portion of each further hanging piece is parallel to the bottom of the intermediate plate; the shelf for boots storage has at least one telescopic member; the telescopic member is assembled to the bottom of the intermediate plate; the telescopic member is able to be drawn back toward the intermediate plate or extended from said intermediate plate; each connecting element is defined as a vertical stick; two sleeving member are respectively assembled at two sides of the intermediate plate; the two sleeving members respectively enclose the two vertical sticks; each sleeving member is adjustably fastened to each corresponding vertical stick via a plurality of fastener; a groove is axially defined on an outer side of each vertical stick; the groove corresponds to the fastener.

Under this arrangement, the boots are placed into the receiving room from two sides of the receiving room; the boot is selectively hung in the hanging space or stood in the receiving room.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
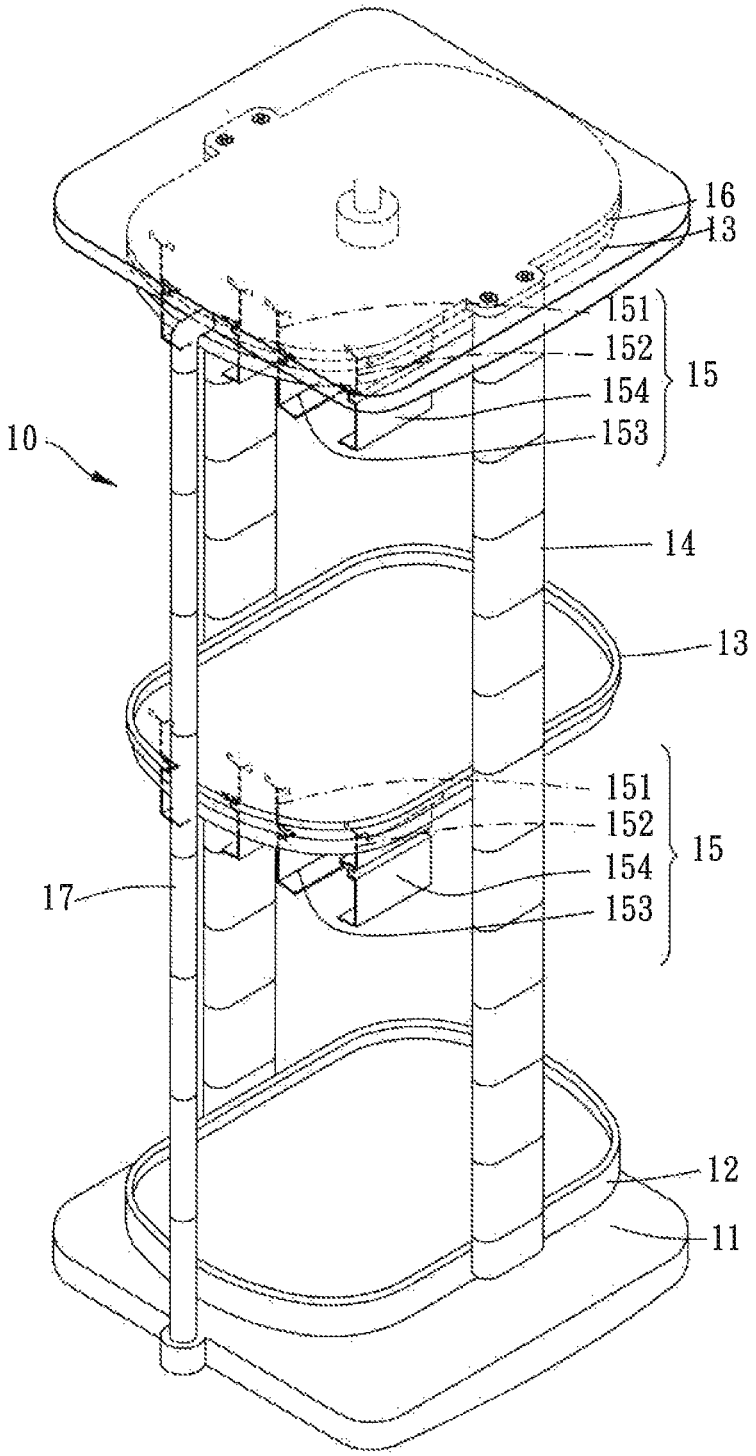
FIG. 1 is a perspective view of a first embodiment of the present invention.
Figure 2:
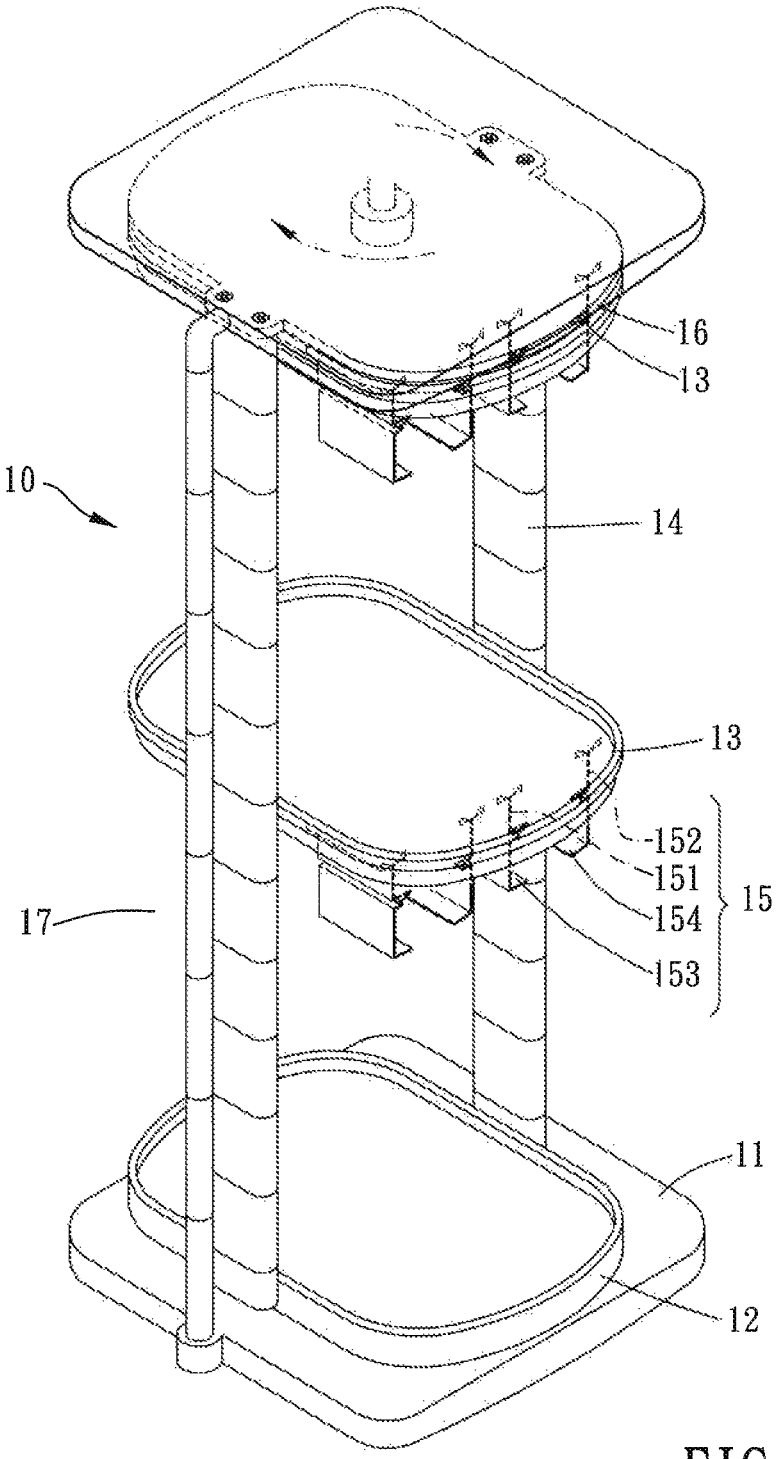
FIG. 2 is a perspective view of a first embodiment for showing an operation.

FIGS. 1-8 show a first embodiment of the present invention. A shelf for boots storage 10 has a base 11, a bottom plate 12, at least one intermediate plate 13, a plurality of connecting elements 14, at least one hanging element 15, a supporting member 19, a clasp member 18, a top plate 16, a post 17 and a top cover 171.

The bottom plate 12 is rotatably assembled on the base 11. Specially, the base 11 has a through hole 111 opened at a center thereof. The bottom plate 12 has a ring protrusion 122 protruded at a bottom thereof. The ring protrusion 122 is rotatably assembled into the through hole 111. The ring protrusion 122 has an engaging structure so as to engage with the through hole 111, so that the bottom plate 12 is prevented from being unexpectedly detached from the base 11. The base 11 has a ring groove 112 defined around a periphery of the through hole 111. The bottom plate 12 has a plurality of balls 121 rollably assembled at the bottom thereof. Each ball 121 is partially received in the ring groove 112 and is rollable along the ring groove 112, so that the bottom plate 12 is smoothly rotatable relative to the base 11 via the balls 121 and the ring groove 112.

The intermediate plate 13 is located at a side of the bottom plate 12 opposite to the base 11. A predetermined distance is defined between the intermediate plate 13 and the bottom plate 12. The connecting elements 14 are connected between a periphery of the intermediate plate 13 and a periphery of the bottom plate 12. Specially the connecting elements 14 divide into two groups. The connecting elements 14 of each said group are concatenated as a bar. One group of the connecting elements 14 is connected between one side of the intermediate plate 13 and one side of the bottom plate 12; another group of the connecting elements 14 is connected between another side of the intermediate plate 13 and another side of the bottom plate 12. A receiving room is defined between the connecting elements 14, the intermediate plate 13, and the bottom plate 12. There is a plurality of said intermediate plates 13 in the first embodiment of the present invention. A distance is defined between each two adjacent intermediate plates 13. Each two adjacent intermediate plates 13 are connected by the corresponding connecting elements 14. A further receiving room is defined between the corresponding connecting elements 14 and each two adjacent intermediate plates 13.

Figure 3:
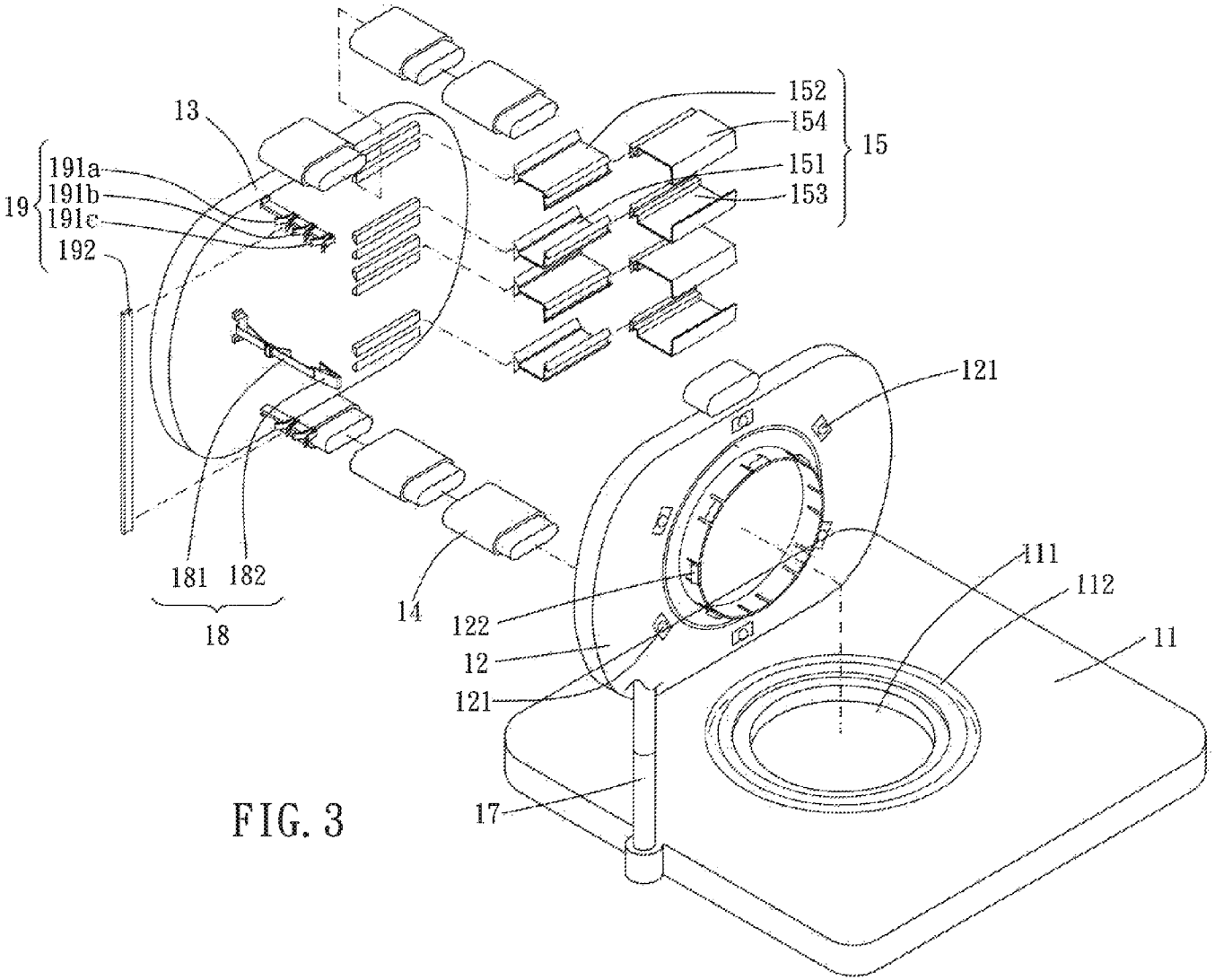
FIGS. 3-4 are partially exploded view of a first embodiment.
Figure 4:
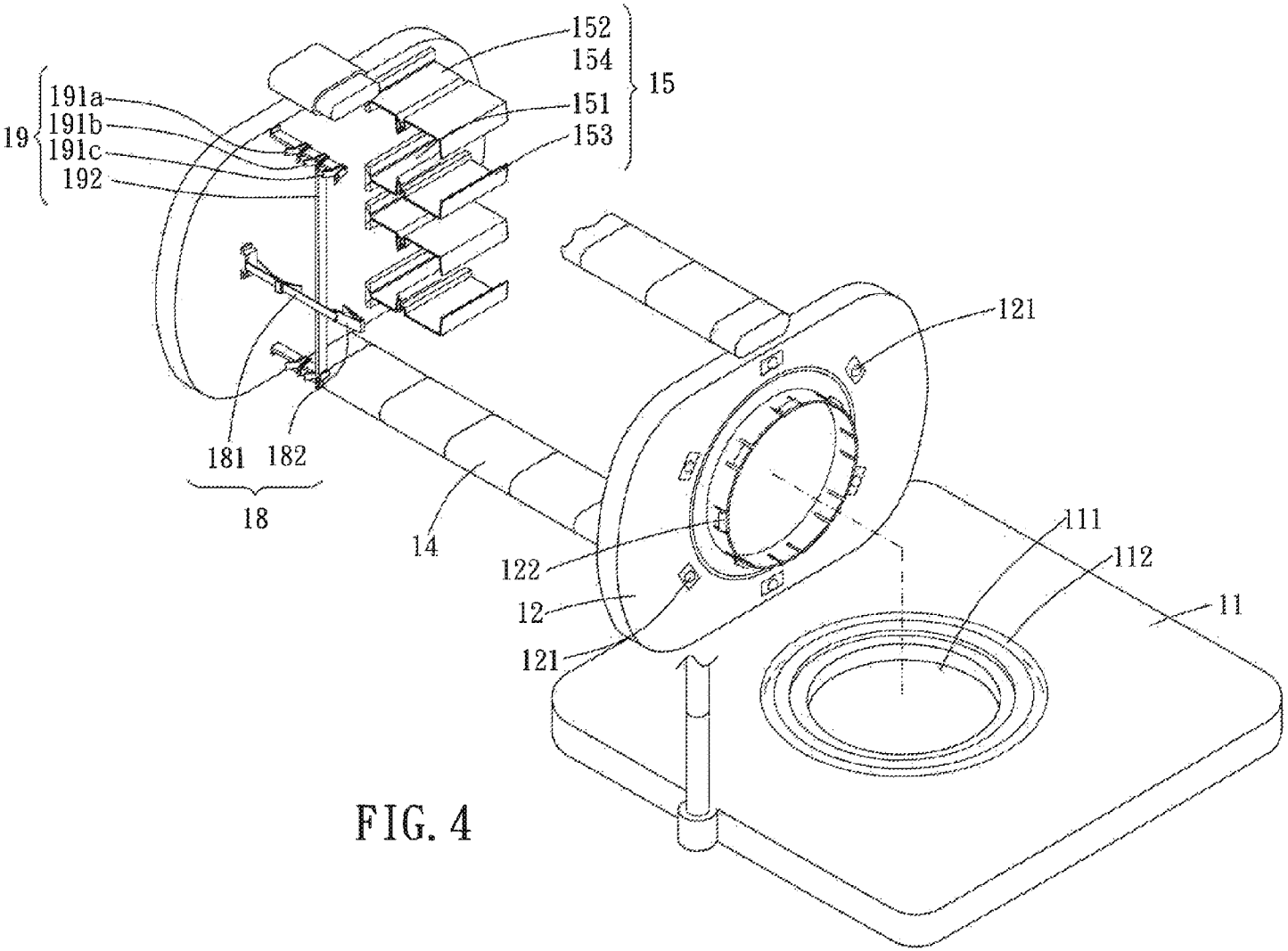
Figure 7:
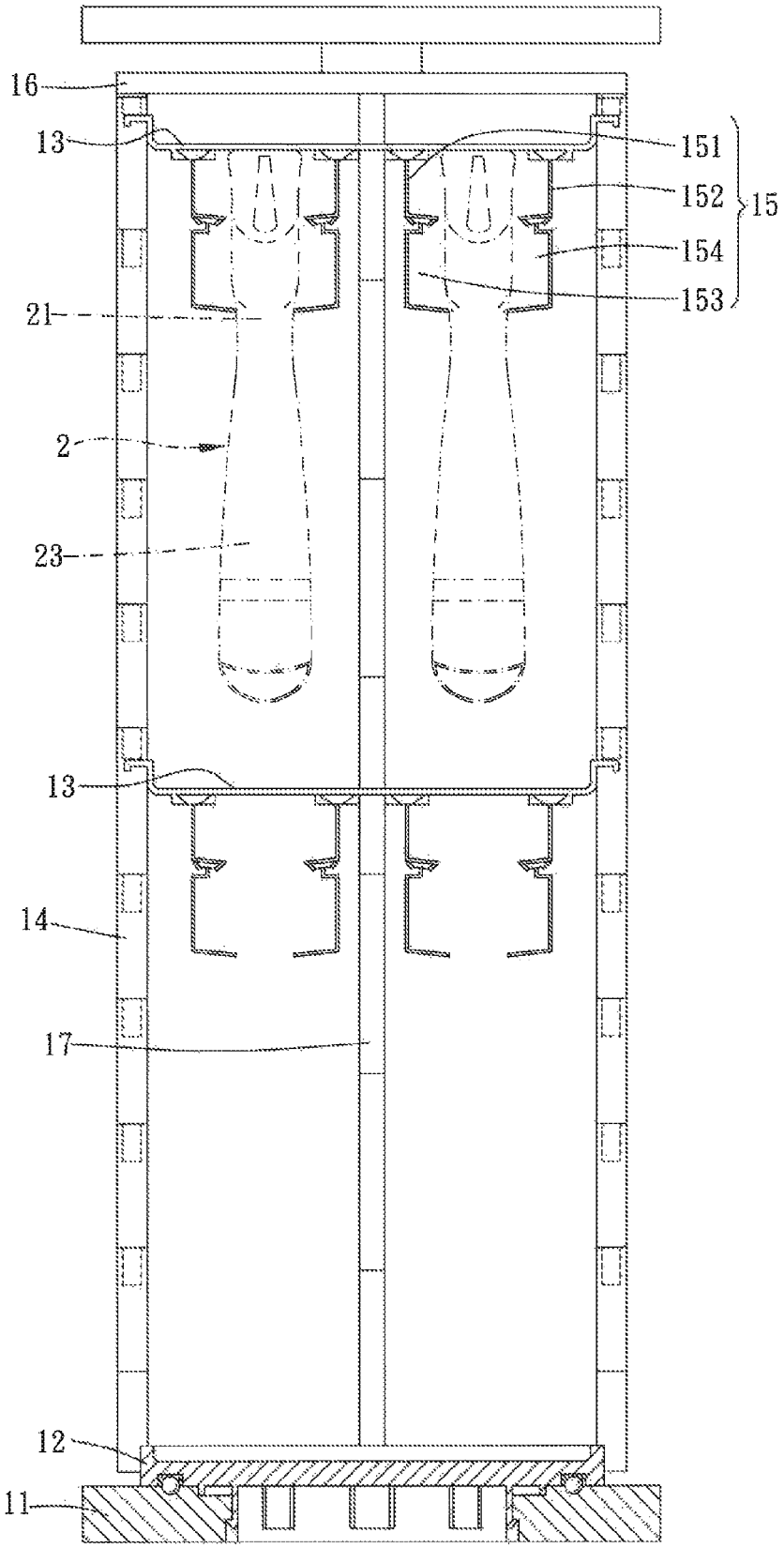
FIG. 7 is a rear view of the first embodiment.
Figure 7A:
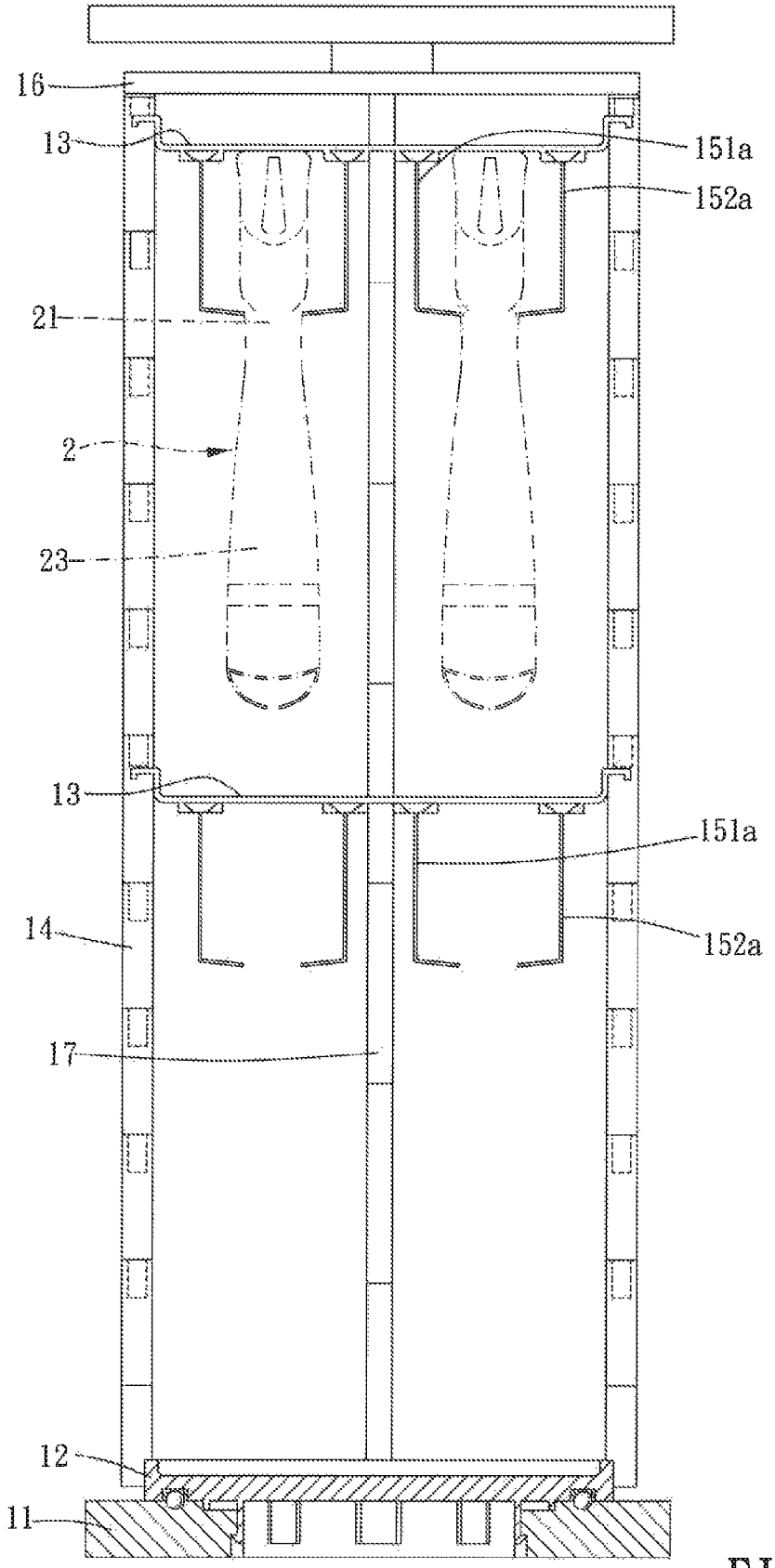
FIG. 7*a* is a rear view of a sub embodiment of the first embodiment.

The hanging element 15 is extended from a bottom of the intermediate plate 13 toward the receiving room. An extended distance of the hanging element 15 is predetermined. A hanging space is defined between the hanging element 15 and the intermediate plate 13. The hanging element 15 has at least one pair of hanging pieces 151, 152 in the first embodiment of the present invention. The hanging pieces 151, 152 are symmetrical with each other. A bottom end of one of the hanging pieces 151, 152 is bent toward another of the hanging pieces 151, 152, so that each of the hanging pieces 151, 152 is L-shaped. A boot 2 or 3 has an ankle portion 21 or 31. The ankle portion 21 or 31 is able to be clamped between the hanging pieces 151, 152. A head portion 22 or 32 of the boot 2 or 3 is located at the hanging space. A top end of each hanging piece 151 or 152 has a dovetailed protrusion (as shown in FIG. 3). The bottom of the intermediate plate 13 has a dovetailed groove. The dovetailed protrusion is detachably assembled at the dovetailed groove. Specially, the hanging element 15 further has at least one pair of further hanging pieces 153, 154. The further hanging pieces 153, 154 are symmetrical with each other. A bottom end of one of the further hanging pieces 153, 154 is bent toward another of the further hanging pieces 153, 154, so that each of the further hanging pieces 153, 154 is L-shaped. Each further hanging piece 153 or 154 is detachably assembled to a bottom end of each corresponding hanging piece 151 or 152. Specially, the bottom end of each hanging piece 151 or 152 has a further dovetailed groove (as shown in FIG. 3). A top end of each further hanging piece 153 or 154 has a further dovetailed protrusion. Each further dovetailed protrusion is detachably assembled at each corresponding further dovetailed groove. Therefore, the hanging space is enlargeable via assembling the further hanging pieces 153, 154, so as to hang the boot 2 with high heel. In addition, the pair of hanging pieces 151, 152 can be replaced with a pair of long hanging pieces 151*a*, 152*a*, so as to enlarge the hanging space (as shown in FIG. 7*a*). The hanging pieces can be directly extruded from the intermediate plate, so that the engaging structure, such as said dovetailed protrusion or dovetailed groove, is not necessary. In addition, two pairs of hanging pieces can be parallelly arranged at two sides of the bottom of the intermediate plate, so as to simultaneously hang two boots. Furthermore, three intermediate plates can be parallelly arranged and there can be two receiving rooms; each receiving room is defined between each two corresponding adjacent intermediate plates; therefore, two boots is able to be hung simultaneously.

The supporting member 19 is extended from the bottom of the intermediate plate 13 toward the receiving room. When one boot 2 or 3 is hung in the hanging space, the boot 2 or 3 is upside-down and the head portion 22 or 32 of the boot 2 or 3 is inserted into the hanging space; the supporting member 19 upwardly abuts against the head portion 22 or 32. Specially, the supporting member 19 has a plurality of supporting frames 191*a*, 191*b*, 191*c* and at least one supporting rod 192. The supporting frames 191*a*, 191*b*, 191*c* are all parallel with the intermediate plate 13. A distance is defined between each two adjacent supporting frames 191*a*, 191*b* or 191*b*, 191*c*. The supporting rod 192 is selectively assembled at one of the supporting frames 191*a*, 191*b*, 191*c*. The supporting rod 192 of the supporting member 19 upwardly abuts against the head portion 22 or 32 (as shown in FIG. 10).

Figure 9:
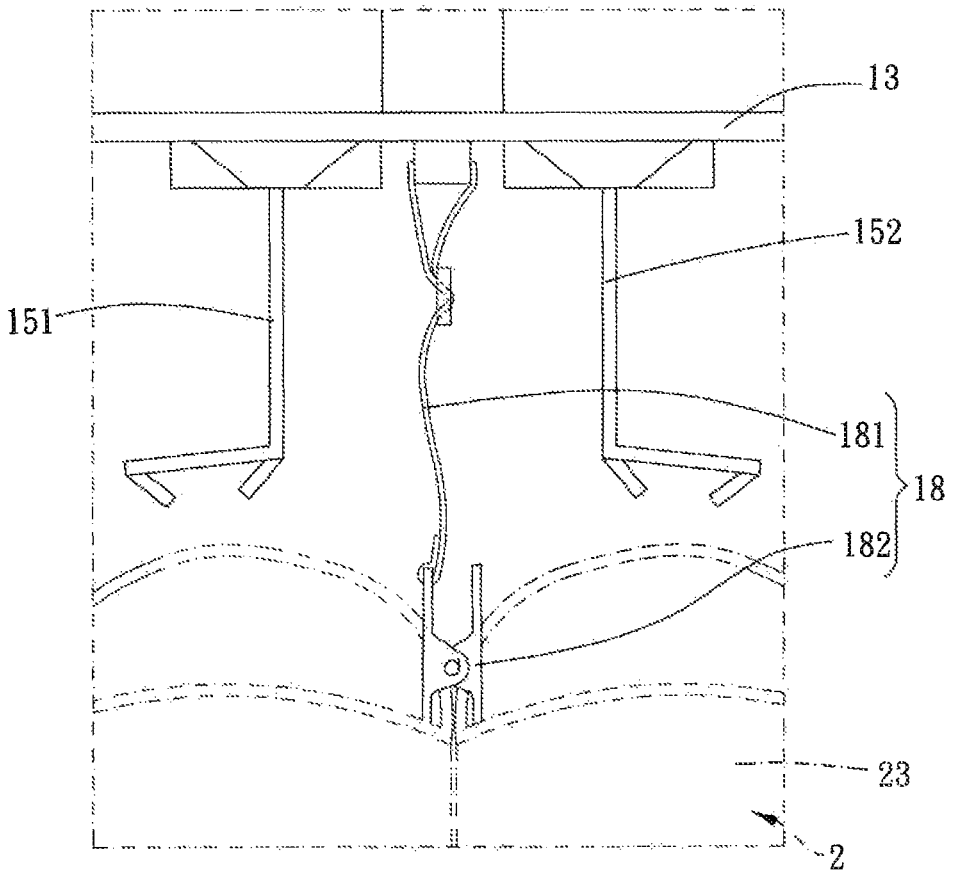
FIGS. 9-10 are partially enlarged view the first embodiment.
Figure 10:
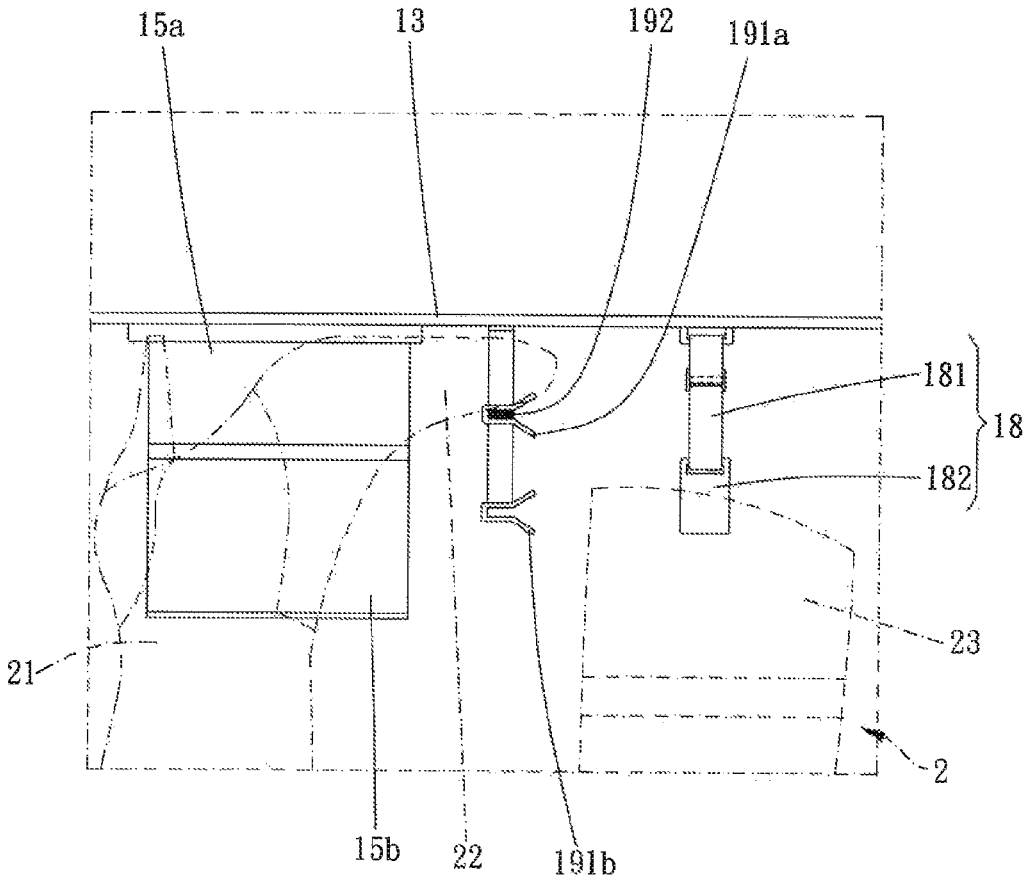

The clasp member 18 is extended from the bottom of the intermediate plate 13 toward the receiving room. The clasp member 18 has a band 181 and a clasp portion 182. The clasp portion 182 is assembled at a bottom end of the band 181. When two boots 2 (or 3) are stood in the receiving room, the clasp portion 182 clasps two long portions 23 (or 33) together. Specially, a length of the band 181 is adjustable, so that the clasp portion 182 is capable of fitly clasping a further long portion with different length from the long portion 23 (or 33);

therefore, the further long portion with different length from the long portion 23 (or 33) is prevented form being downcast (as shown in FIGS. 9-10).

The top plate 16 is located above the intermediate plate 13, so that the intermediate plate 13 is located between the top plate 16 and the bottom plate 12. The top plate 16 is connected to the intermediate plate 13. The top cover 171 is located above the top plate 16. The top cover 171 is rotatably connected to the top plate 16. One end of the post 17 is connected to the base 11; another end of the post 17 is connected to the top cover 171. Specially, the post 17 is connected between a periphery of the top cover 171 and a periphery of the base 11, so that a structure of the whole shelf for boots storage 10 is strengthened, even if there are many intermediate plates 13 arranged between the top plate 16 and the bottom plate 12 and a height of a gravity center of the shelf for boots storage 10 is increased. In addition, when the bottom plate 12 is rotated relative to the base 11, said rotation is smooth because of the post 17.

Figure 5:
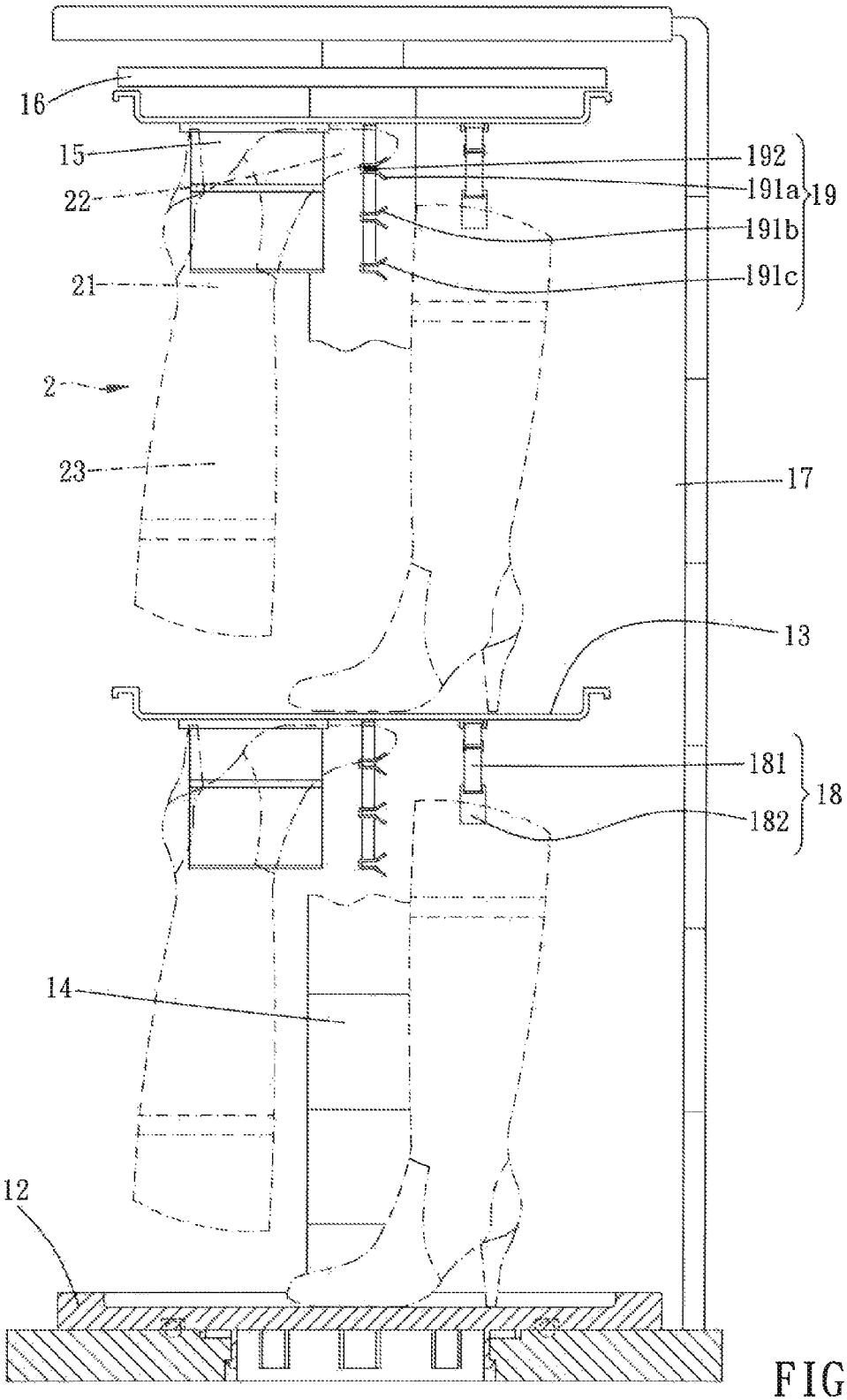
FIG. 5 is a side view of the first embodiment.
Figure 6:
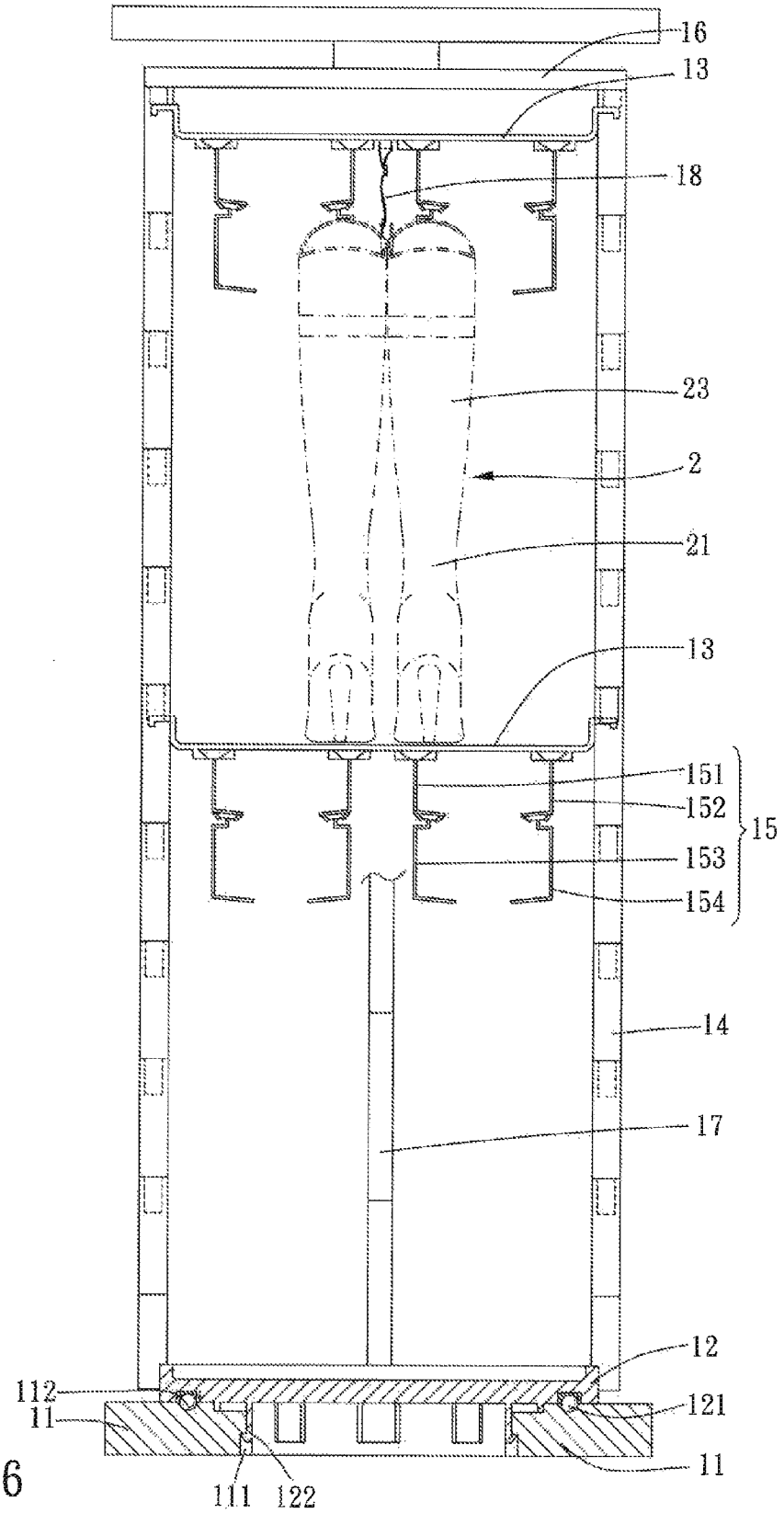
FIG. 6 is a front view of the first embodiment.
Figure 8:
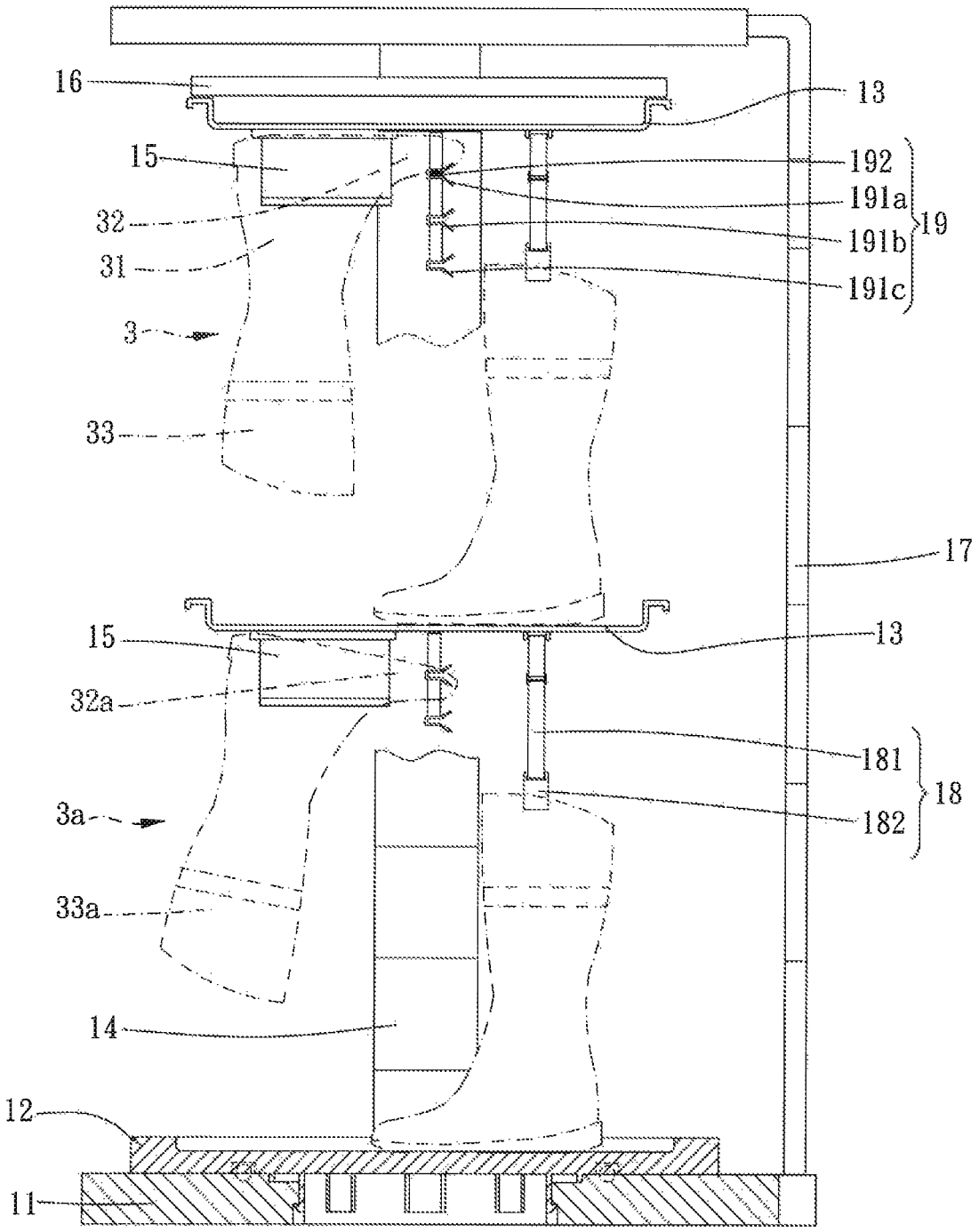
FIG. 8 is a side view of the first embodiment.

Referring to FIGS. 5 and 8, the boots 2 or 3 are selectively placed into one of the receiving rooms; the boots 2 or 3 are placed into one receiving room from two sides of said one receiving room. The boot 2 or 3 is selectively hung in the hanging space or stood in the receiving room. When there are two boots 2 or 3, one boot 2 or 3 is hung in the hanging space from one side of the hanging space; another boot 2 or 3 is stood in the receiving room at another side of the hanging space. Therefore, a positioning mode of the boots 2 or 3 is selectable; the long portion 23 (or 33) is prevented form being downcast because of the supporting member 19 and the clasp member 18.

Furthermore, a distance between the supporting rod 192 and the intermediate plate 13 is adjustable so as to hang boots 2 or 3 with various thicknesses of the head portions 22 or 32, because the supporting member 19 has the supporting frames 191*a*, 191*b*, 191*c*; therefore, the long portion of the boot is prevented from emerging from the receiving space. Referring to FIG. 8, the boot 3 is fitly supported by the supporting member 19, so that the long portion 33 is straight; the boot 3*a* is not fitly supported by the supporting member 19, so that the long portion 33*a* is inclined and emerges from the receiving space. In addition, a length of the clasp member 18 is adjustable, so that the long portion 23 or 33 is able to be fitly clasped by the clasp member 18 and to be straight.

Figure 11:
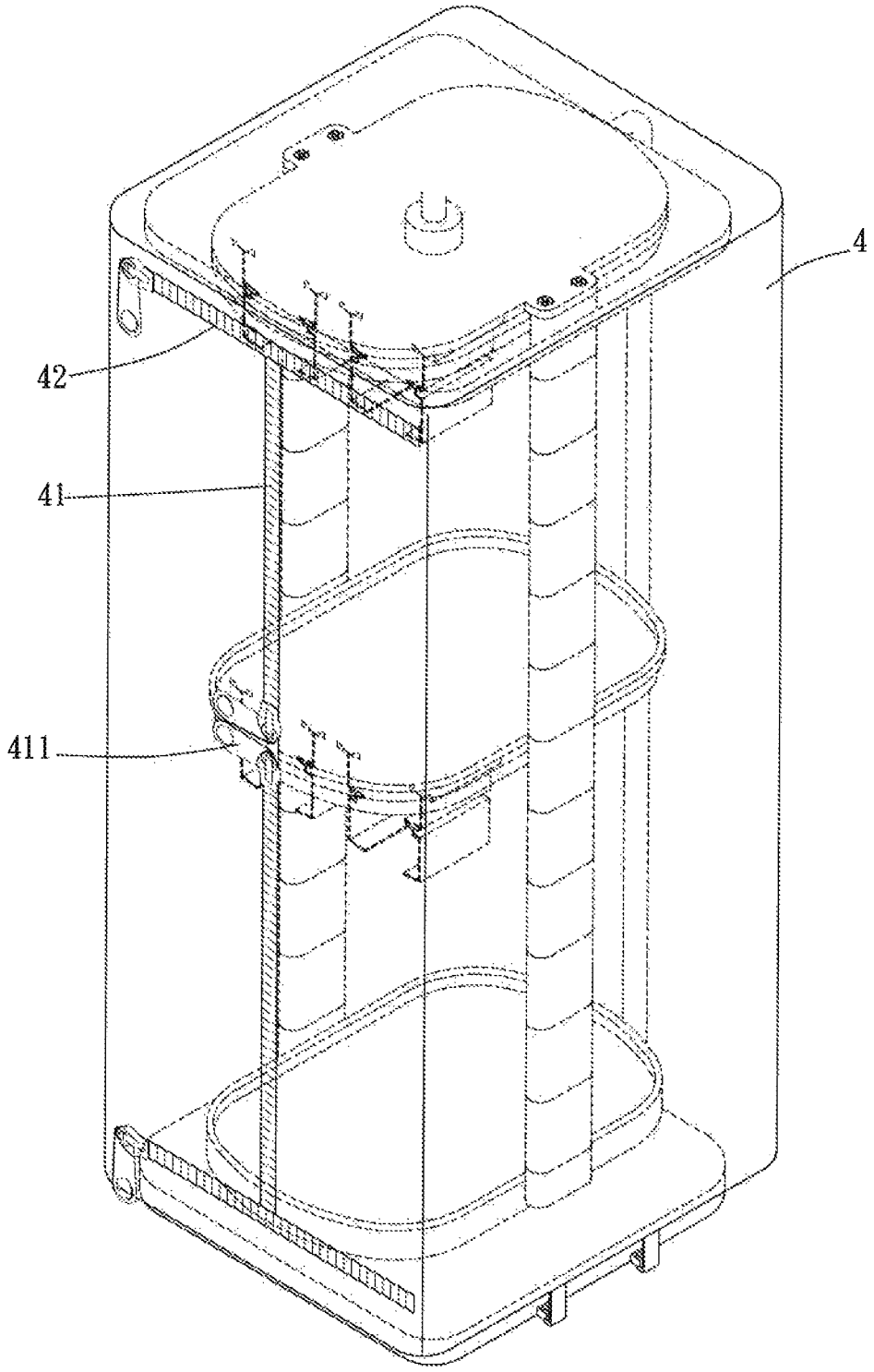
FIG. 11 is a perspective view of a second embodiment of the present invention.
Figure 12:
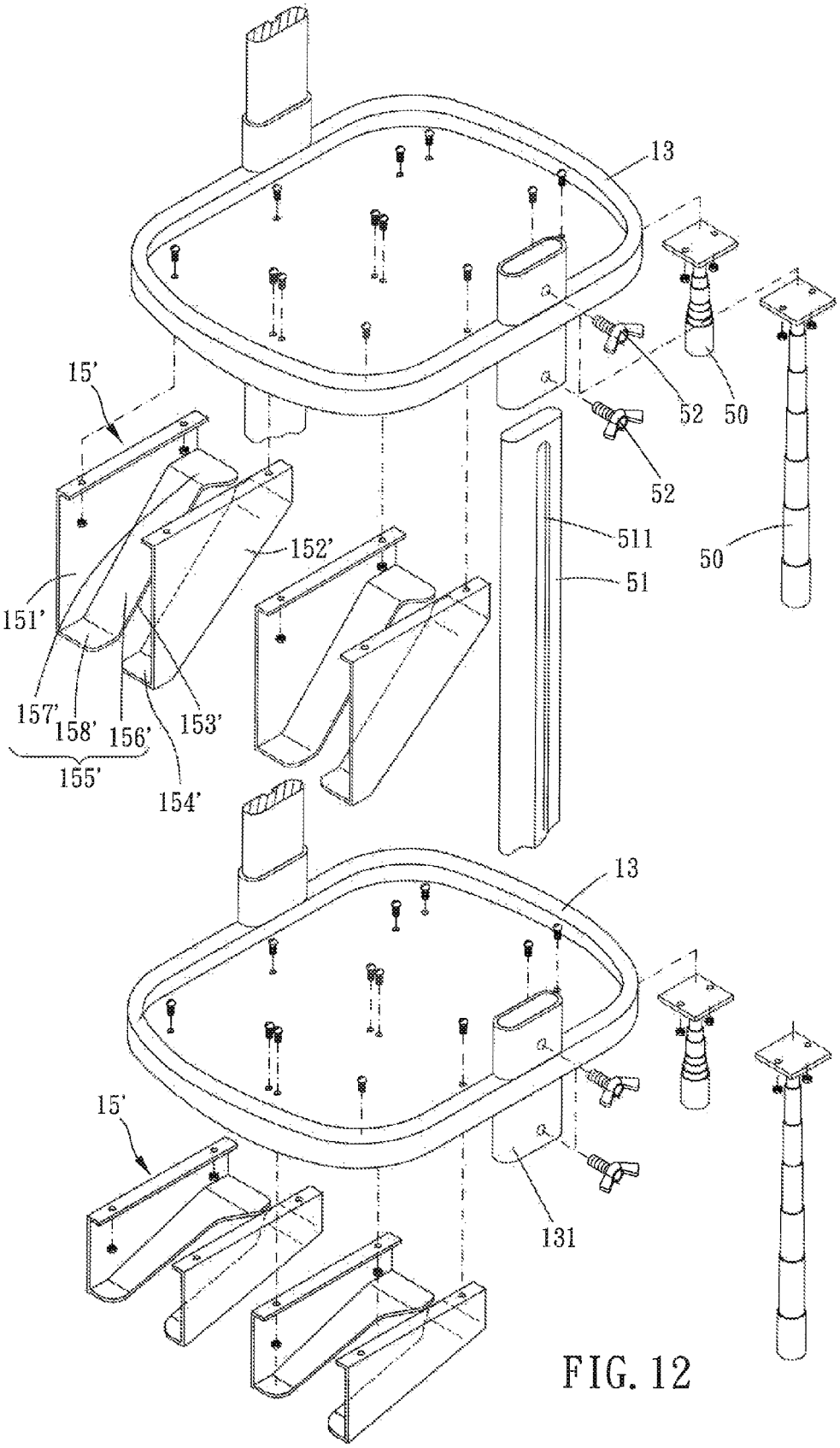
FIG. 12 is a partially exploded view of a third embodiment of the present invention.
Figure 13:
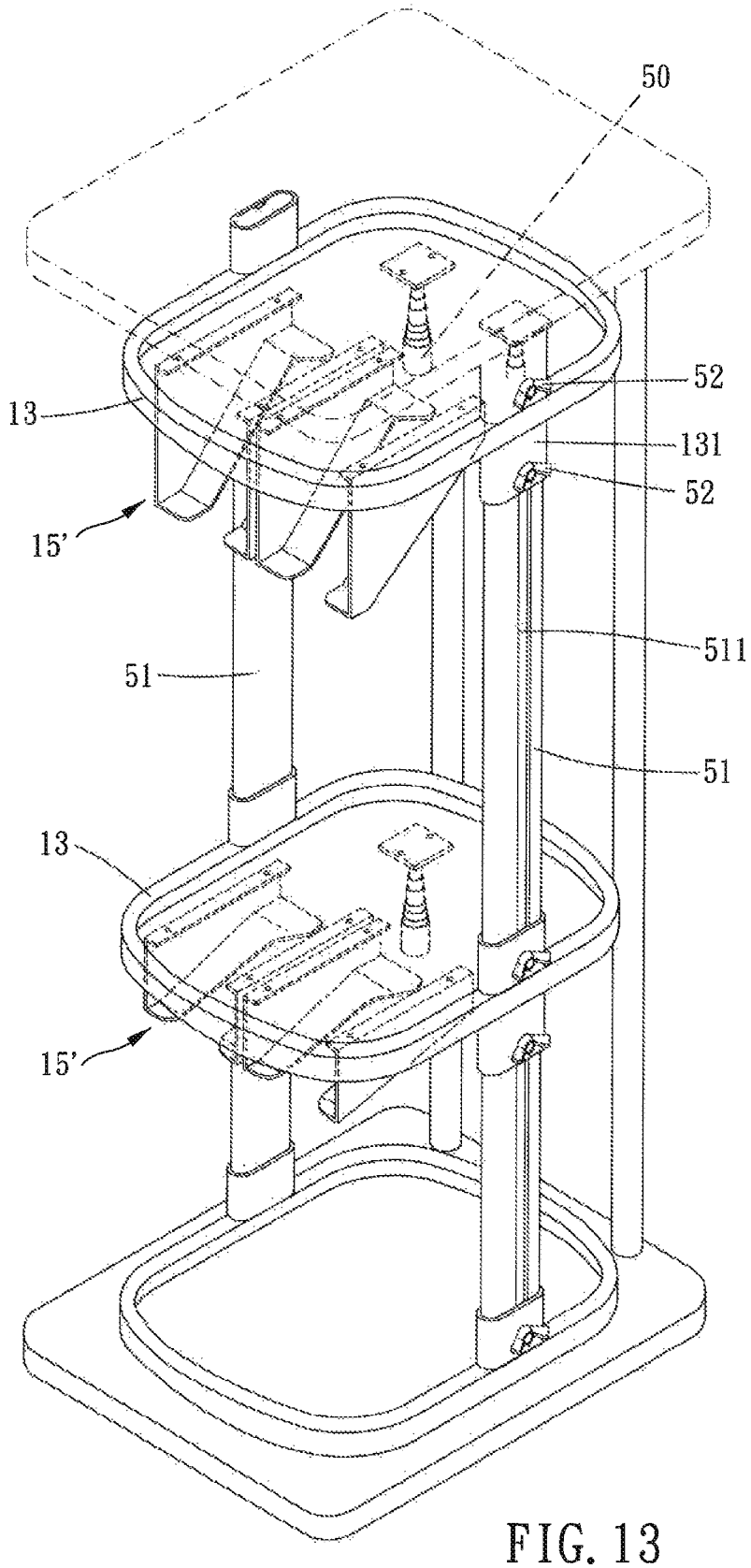
FIG. 13 is a perspective view of the third embodiment.

Besides, retelling to FIG. 11, the shelf for boots storage of the present invention further has a dust cover 4. The dust cover 4 is mounted around the shelf for boots storage. The dust cover 4 has at least one vertical zip member 41 which is vertically extended, and at least one horizontal zip member 42 which is horizontally extended. Specially, the vertical zip member 41 has two pull tabs 411. One pull tab 411 can be zipped up to open the vertical zip member 41; another pull tab 411 can be zipped down to open the vertical zip member 41. Therefore, the user can selectively open an upper portion of the vertical zip member 41 or a lower portion of the vertical zip member 41.

FIGS. 12-15 show a third embodiment of the present invention. The shelf for boots storage has a plurality of hanging members 15' (or at least one). Each hanging element 15' is assembled (or screwed) to a bottom of an intermediate plate 13. Only the differences between the first embodiment and the third embodiment would be described. Two hanging pieces 151', 152' are respectively integrated with two further hanging pieces 153', 154' of each hanging element 15'. Each further hanging piece 153' or 154' of each hanging element 15' has a supporting plane 155' which faces the intermediate plate 13. A passage is defined between the two further hanging pieces 153', 154' so that an ankle portion of a boot can be positioned at the passage. Each supporting plane 155' has an inclined portion 156' which is inclinedly extended form a bottom of the intermediate plate 13 toward the receiving room. A horizontal portion 157' is horizontally extended from a top end of the inclined portion 156'. The horizontal portion 157' of each further hanging piece 153' or 154' is parallel to the bottom of the intermediate plate 13. The two further hanging pieces 153', 154' both correspond to a shape of the of the head portion 22 of the boot. A positioned space is defined between the horizontal portion 157' and the intermediate plate 13 so as to position the head portion 22 of the boot. Specially, a width of the horizontal portion 157' is longer than a width of the inclined portion 156'. The horizontal portion 157' is dovetailed so as to completely support the head portion 22 of the boot. An extended portion 158' is horizontally extended from a bottom end of the inclined portion 156'. An extended direction of the extended portion 158' is diametrically opposed to an extended direction of the horizontal portion 157'. The extended portion 158' of each further hanging piece 153' or 154' is parallel to the bottom of the intermediate plate 13. A corner portion is defined by the inclined portion 156' and the extended portion 158' so as to prevent the boot from dropping down from the hanging element 15'.

The shelf for boots storage has a plurality of telescopic members 50 (or at least one). Each telescopic member 50 is assembled (such as being screwed) to the bottom of the intermediate plate 13. Specially, two connecting elements are respectively and adjustably connected to two sides of the intermediate plate 13. Each connecting element is defined as a vertical stick 51 which is formed as one piece. Clearly, two sleeving member 131 are respectively assembled at two sides of the intermediate plate 13. The two sleeving member 131 could be integrated with the intermediate plate 13. The two sleeving members 131 respectively enclose the two vertical sticks 51. Each sleeving member 131 is fastened to each corresponding vertical stick 51 via a fastener 52 (the at least one fastener 52 could be a screw). A groove 511 is axially defined on an outer side of each vertical stick 51. The groove 511 corresponds to the fastener 52.

Figure 14:
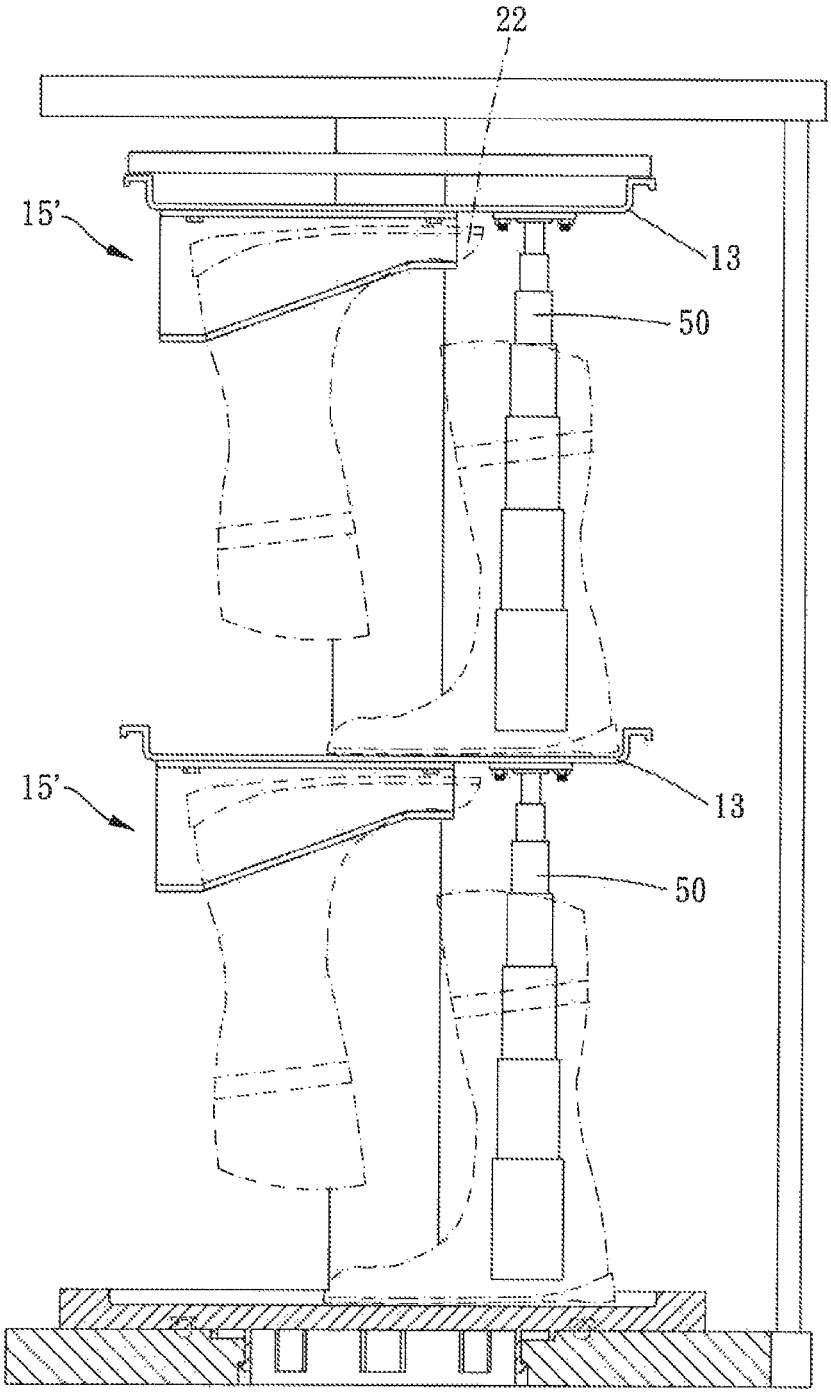
FIG. 14 is a side view of the third embodiment for showing an operation.
Figure 15:
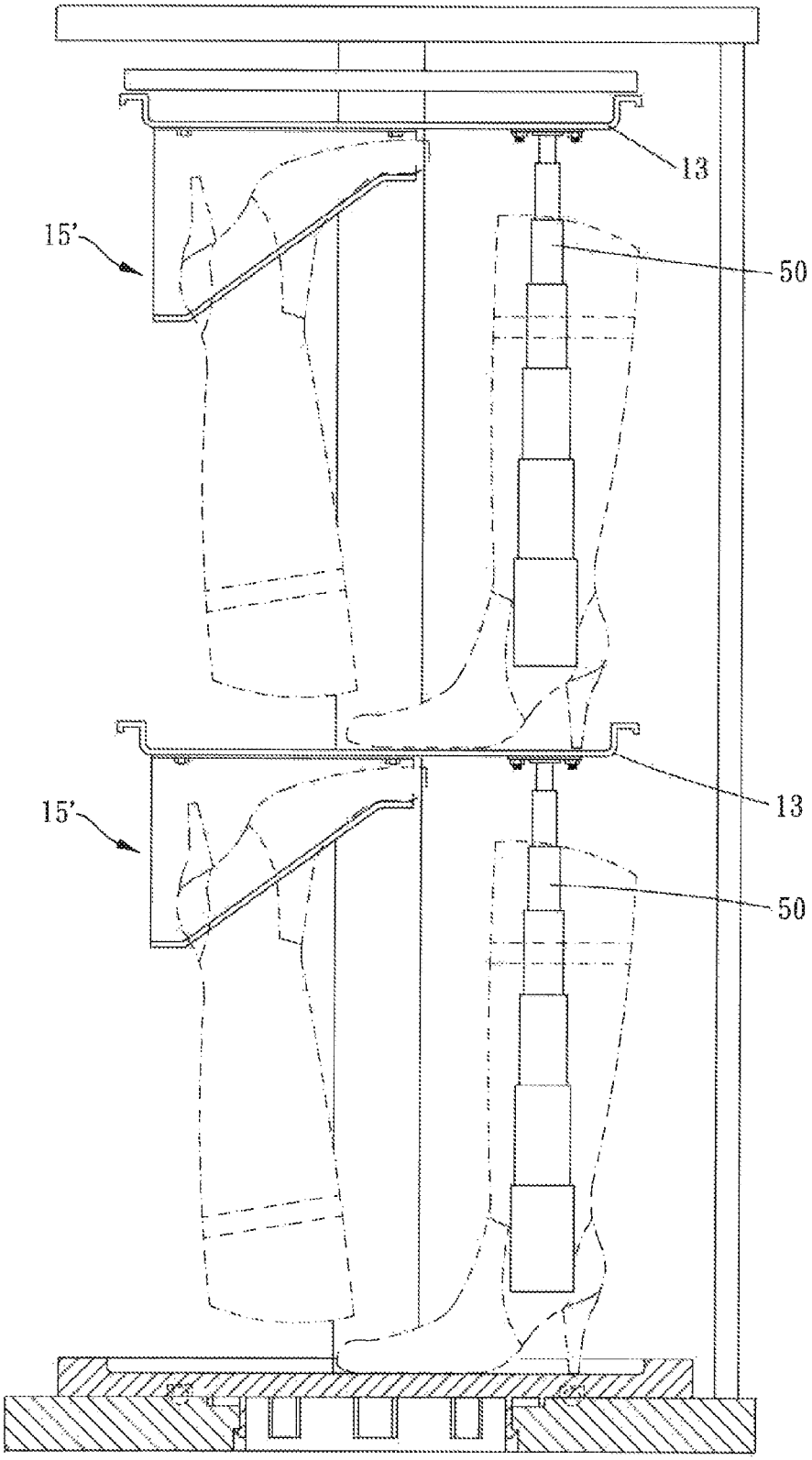
FIG. 15 is a side view of a sub embodiment of the third embodiment for showing an operation.

Referring to FIG. 14, when the user places a boot with a shorter long portion into the receiving room, the telescopic member 50 is drawn back toward the intermediate plate 13 at first; then, a boot is stood in the receiving room; thereafter, the telescopic member 50 is extended toward an inside of the boot; as a result, the boot is completely positioned. Referring to FIG. 15, when the user places a boot with a longer long portion into the receiving room, the user release each fastener 52 and the intermediate plate 13 is axially movable relative to the two vertical sticks 51; thereafter, the user adjusts the receiving space via moving the intermediate plate 13, so as to fitly position the boot at the receiving room; finally, the telescopic member 50 is extended toward an inside of the boot to completely position the boot. Therefore, the present invention is provided for boots with different sizes. Wherein, when the intermediate plate 13 is moving, the fastener 52 is partially extended into the groove 511, so that the motion of the intermediate plate 13 is stable.

All in all, the receiving space is adjustable so as to fit the boot; the long portion of the boot is prevented form being downcast; the present invention is easy to operate; the structure of the present invention is strong; it is easy to manufacture the present invention; the present invention is low-cost.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shelf for boots storage comprising:

a base;

a bottom plate rotatably assembled on the base;

at least one intermediate plate located at a side of the bottom plate opposite to the base, a predetermined distance defined between the intermediate plate and the bottom plate;

a plurality of connecting elements connected between the intermediate plate and the bottom plate, a receiving room defined between the connecting elements, the intermediate plate, and the bottom plate; and at least one hanging element extended from a bottom of the intermediate plate toward the receiving room, an extended distance of the hanging element being predetermined, a hanging space defined between the hanging element and the intermediate plate;

wherein each hanging element is assembled to a bottom of the corresponding intermediate plate; each hanging element has two vertical hanging pieces which are extended from bottom of the corresponding intermediate plate toward the receiving space; two further hanging pieces respectively horizontally extended from the two vertical hanging pieces;

each further hanging piece of each hanging member has a supporting plane which faces the intermediate plate; each supporting plane has an inclined portion which is inclinedly extended from a bottom of the intermediate plate toward the receiving room, and a horizontal portion which is horizontally extended from a top end of the inclined portion; the horizontal portion of each further hanging piece is parallel to the bottom of the intermediate plate;

wherein, the boots are selectively placed into the receiving room from one of two corresponding sides of the receiving room; each boot is selectively hung in the hanging space of a respective hanging element with a bottom of the boot upward and a head portion of the boot being inserted into the receiving room or stood in the receiving room with its bottom downward.

2. The shelf for boots storage as claimed in claim 1, wherein the shelf for boots storage thither has a top plate, a post and a top cover; the top plate is located above the intermediate plate; the top cover is located above the top plate; the top plate is connected to the intermediate plate; the top cover is rotatably connected to the top plate; one end of the post is connected to the base; another end of the post is connected to the top cover.

3. The shelf for boots storage as claimed in claim 1, wherein there is a plurality of said intermediate plates; a distance is defined between each two adjacent intermediate plates; each two adjacent intermediate plates are connected by the corresponding connecting elements; and additional receiving room is defined between the corresponding connecting elements and each two adjacent intermediate plates.

4. The shelf for boots storage as claimed in claim 1, wherein an extended portion is horizontally extended from a bottom end of the inclined portion; an extended direction of the extended portion is opposite to an extended direction of the horizontal portion relative the inclined portion; each extended portion is substantially parallel to the bottom of the intermediate plate.

5. The shelf for boots storage as claimed in claim 1, wherein the shelf for boots storage has at least one telescopic member; the telescopic member is assembled to the bottom of the intermediate plate; the telescopic member is able to be drawn back toward the intermediate plate or extended from said intermediate plate.

6. The shelf for boots storage as claimed in claim 1, wherein each connecting element is defined as a vertical stick; two sleeving member are respectively assembled at two sides of the intermediate plate; the two sleeving members respectively enclose the two vertical sticks; each sleeving member is adjustably fastened to each corresponding vertical stick via a plurality of fasteners.

7. The shelf for boots storage as claimed in claim 6, wherein a groove is axially defined on an outer side of each vertical stick; the groove corresponds to the fasteners.

* * * * *